US006968956B2

(12) United States Patent
Iwasaki

(10) Patent No.: US 6,968,956 B2
(45) Date of Patent: Nov. 29, 2005

(54) SEPARATION APPARATUS AND METHODS

(75) Inventor: Iwao Iwasaki, Grand Rapids, MN (US)

(73) Assignee: Regents of the University of Minnesota, Minneapolis, MN (US)

( * ) Notice: Subject to any disclaimer, the term of this patent is extended or adjusted under 35 U.S.C. 154(b) by 304 days.

(21) Appl. No.: 10/081,176

(22) Filed: Feb. 22, 2002

(65) Prior Publication Data

US 2003/0159976 A1 Aug. 28, 2003

(51) Int. Cl.[7] ..... B03B 7/00; B03B 5/28; B03B 5/62; B03C 1/30; B03D 1/14

(52) U.S. Cl. ..... 209/164; 209/168; 209/169; 209/170; 209/39; 209/40; 209/214; 209/228; 209/232

(58) Field of Search ..... 209/39, 40, 164, 209/168, 169, 170, 214, 228, 232

(56) References Cited

U.S. PATENT DOCUMENTS

| | | | | |
|---|---|---|---|---|
| 2,364,777 A | | 12/1944 | Brown et al. | |
| 2,364,778 A | | 12/1944 | Brown et al. | |
| 2,450,720 A | | 10/1948 | De Vaney | |
| 2,468,586 A | | 4/1949 | Braund | |
| 3,292,780 A | | 12/1966 | Frommer et al. | |
| 3,850,811 A | * | 11/1974 | Wheelock | 210/223 |
| 4,186,087 A | | 1/1980 | Kato | |
| 4,192,738 A | | 3/1980 | Colombo et al. | |
| 4,298,169 A | | 11/1981 | Iwasaki | |
| 4,301,973 A | | 11/1981 | Lai | |
| 4,643,822 A | | 2/1987 | Parsonage | |
| 4,735,707 A | | 4/1988 | Bustamante | |
| 5,307,938 A | | 5/1994 | Lillmars | |
| 5,507,393 A | | 4/1996 | Yang | |
| 5,551,574 A | | 9/1996 | Hicks et al. | |
| 6,056,125 A | | 5/2000 | Lai et al. | |
| 6,273,265 B1 | | 8/2001 | Greenwalt | |

FOREIGN PATENT DOCUMENTS

EP 510849 A2 * 10/1992 ..... B03C 1/025

OTHER PUBLICATIONS

Ersayin et al., "Magnetically Enhanced Hydroseparator," *Minerals and Metallurgical Processing*, Nov. 2002, 19(4): 187-191.

Ersayin et al., "Magnetic field application in cationic silica flotation of magnetic taconite concentrates," *Minerals and Metallurgical Processing*, Aug. 2002; 19(3):148-153.

Arbiter et al., "Attritioning and Conditioning in Spodumene Flotation," *Quarterly of the Colorado School of Mines*, Jul. 1961; 56(3):321-332.

Ersayin et al., "Magnetically Enhanced Hydroseparator," MEGS, 2001, Falmouth, UK, Jun. 19-21, 2001, presentation slides and abstract, 25 pgs.

Iwasaki, "Design of a Magnetic Field Distribution Device for Application in Hydroseparators and Flotation Cells," Progress Report No. 2, Coleraine Minerals Research Laboratory, Natural Resources Research Institute, Univ. of Minnesota-Duluth, CMRL/TR-01/06, NRRI/TR-2001/16, May 2, 2001 (released to public Feb. 27, 2002); 10 pgs.

(Continued)

*Primary Examiner*—Thomas M. Lithgow
(74) *Attorney, Agent, or Firm*—Mueting, Raasch & Gebhardt, P.A.

(57) ABSTRACT

A separation apparatus and method for use in separating magnetic material from non-magnetic material that includes the use of a magnetic grid, e.g., a permanently magnetic grid, which defines a plurality of openings. The grid assists in preventing magnetic material from being transported to an overflow.

42 Claims, 8 Drawing Sheets

OTHER PUBLICATIONS

Iwasaki et al., "Effect of Magnetizing/Demagnetizing on Cationic Silica Flotation Under a Magnetic Field," Final Report, Coleraine Minerals Research Laboratory, Natural Resources Research Institute, Univ. of Minnesota-Duluth, CMRL/TR-01-20, NRRI/TR-2002/04, Oct. 17, 2001 (released to public Feb. 27, 2002); 8 pgs.

Iwasaki et al., "Magnetic Field Application in Cationic Silica Flotation," Final Report, Coleraine Minerals Research Laboratory, Natural Resources Research Institute, Univ. of Minnesota-Duluth, CMRL/TR-01-04, NRRI/TR-2001/14, May 4, 2001 (released to public Feb. 27, 2002); 1-39.

Iwasaki et al., "Magnetic field application in hydroseparators," Final Report with Addendum, Coleraine Minerals Research Laboratory, Natural Resources Research Institute, University of Minnesota-Duluth, CMRL/TR-01-04, NRRI/TR-2001/14, Apr. 25, 2001; addendum dated May 25, 2001 (released to public Feb. 27, 2002); 43 pgs.

Iwasaki et al., "Magnetic Field application in hydroseparators and flotation cells," Progress Report No. 1, Coleraine Minerals Research Laboratory, Natural Resources Research Institute, Univ. of Minnesota-Duluth, CMRL/TR-0012, NRRI/TR-2000/38, Aug. 10, 2001 (released to public Feb. 27, 2002); 22 pgs.

Quarterly Report, Natural Resources Research Institute, Oct.-Dec. 2000; 1 pg.

Quarterly Report, Natural Resources Research Institute, Jan.-Mar. 2001; 1 pg.

Quarterly Report, Natural Resources Research Institute, Apr.-Jun. 2001; 1 pg.

Roe, *Iron Ore Beneficiation*, Minerals Publishing Co., Lake Bluff, Ill., 1957; 159.

Roe, "The Magnetic Reflux Classifier," *Mining Engineering*, Mar. 1953; 5:312-315.

Seetharama et al., "Part 1: Magnetite Depressant Reagent Development. Section 4: Effect of Magnetic Fields in the Flotation of Magnetic Concentrates," *Investigation into Production of Iron Ore Concentrates wiht Less Than 3 Percent Silica from Minnesota Taconites*, Final Report to the State of Minnesota and the American Iron and Steel Institute, Department of Civil and Mineral Engineering, Univ. of Minnesota, Minneapolis, MN, Oct. 15, 1991; 31 pgs.

2002 SME Annual Meeting & Exhibit, Technical Program Feb. 25-27, 2002 (available to public Nov. 2001); Phoenix, AZ, (2 pgs.).

Sonolikar et al., "Chapter 33: Effect of Magnetic Field on Column Flotation of Ore Containing Magnetic Content," *Column Flotation '88*, Sastry Ed., SME Annual Meeting, Phoenix, AZ, Jan. 25-28, 1988; 299-304.

Wu et al., "The Flotation of Taconite in a Magnetic Field," Proceedings of 68th Annual Meeting, Minnesota Section SME, and 56th Mining Symposium, Univ. of Minnesota, Center for Professional Development, Univ. of Minnesota-Duluth, Jan. 24-26, 1995; 245-256.

* cited by examiner

SEPARATION APPARATUS AND METHODS

FIELD OF THE INVENTION

The present invention relates to the field of separation apparatus and methods. More particularly, the present invention relates to apparatus and methods for use in separation of magnetic material from non-magnetic material.

BACKGROUND

Various types of conventional separation techniques are used to separate magnetic material from non-magnetic material. For example, slurries containing both magnetic material and non-magnetic material are commonly processed by hydroseparators and flotation cells to separate the magnetic material from the nonmagnetic material. One problem associated with various separation techniques concerns the loss of fine magnetite particles in such processes, e.g., fine, high grade magnetite particles (i.e., having a diameter less than or equal to 25 $\mu$m or −500 mesh).

A hydroseparator is a concentration apparatus commonly used in taconite plants. It is generally used to treat cyclone overflow from, for example, rougher magnetic separation and may, for example, be followed by a finisher magnetic separation stage. In principle, a hydroseparator process is similar to a selective flocculation process. Magnetically flocculated slurry is fed to a hydroseparator, which is designed to operate in such a way that suspended fine gangue particles leave the hydroseparator in an overflow. A hydroseparator's effectiveness is typically affected by the delicate balance needed between the amount of gangue separated and magnetic iron losses.

Each plant generally has its own strategy for operating such separation devices. Some plants may be more concerned with magnetic iron recovery and, therefore, operate hydroseparators at low upward velocities, while for others, it may be more important to separate silicate bearing minerals as efficiently as possible using higher velocities, thereby compromising recovery. For example, 35% to 65% of silica in a fine (−25 $\mu$m or −500 mesh) size fraction may be separated using hydroseparators operating with upward velocities that may vary between 1.7 mm/sec and 3.2 mm/sec (0.07 inch/sec and 0.13 inch/sec). Higher velocities may provide more effective separation of fine silicate minerals, but at the same time may increase magnetic iron losses.

In principle, high magnetic iron losses could be prevented for a hydroseparator by applying a magnetic field to capture particles going into an overflow stream, while operating the hydroseparator efficiently at high upward velocities. This principle was tested by Roe ("The Magnetic Reflux Classifier", *Mining Engineering,* 5(3):312–315, March (1953)), who used a laboratory classifier tube of 46 mm (1.8 inch) internal diameter with a magnetic field imposed using a DC electromagnet coil near the top of the tube. The flux density was varied at the internal surface of the tube wall. Roe reported that high silica middlings along with free silica particles could be removed by careful control of the magnetic field and water supply. While an electromagnet may be used conveniently in a laboratory separator, its use in commercial separators of large diameter (e.g., 5–15 m or 15–50 ft) may pose various problems. For example, it is difficult to provide a strong enough magnetic field at the middle or center of such large separators with an electromagnet that surrounds the outer perimeter thereof.

In many circumstances, the concentration of magnetite in resultant magnetic material (e.g., material resulting from separation processes) must meet certain specifications. For example, current blast furnace practice (e.g., processing of magnetite) requires the silica content in taconite pellets to be in the neighborhood of 4%, and, for emerging technologies of direct reduction and direct smelting, even a lower silica content, e.g., less than 2%, may be desired.

In the processing of magnetic taconite, cationic flotation using, for example, flotation cells or columns, has been utilized to lower the silica content of magnetic concentrates. Size fractions coarser than 325 mesh become progressively higher in silica content in the form of locked siliceous gangue particles.

Efficiency is important when flotation is used as the last stage for concentration of ores when ores contain clay-type minerals. For example, fine slimes (e.g., those containing clay-type minerals) consume reagents used in such processes (e.g., for cationic flotation), such as primary amines, ether amines, and quaternary ammonium salts, leading to increased consumption of such reagents and decreased efficiency of flotation separation.

However, attempts to float coarse siliceous gangue by adding greater quantities of cationic collectors leads to an excessive loss of fine magnetite and, thereby, the iron recovery drops precipitously when the silica content in the flotation concentrates is lowered to below 4%. In the cationic silica flotation of magnetic taconite concentrates, iron losses are high due to simultaneous flotation of fine, well liberated, high-grade magnetite along with coarse middlings locked with magnetite.

Efforts have been made to develop more selective collectors and depressants to remove silica from magnetic taconite concentrates and minimize the flotation of fine, high-grade magnetite. However, various problems have occurred. For example, some reagents are not only expensive, but also may become an environmental concern in tailing ponds.

The use of a magnetic field to minimize magnetic material loss has also been reported in conjunction with flotation apparatus such as flotation columns. Its use is attractive not only because of lower cost, but also because of its limited effect on the environment.

For example, the use of a magnetic field in flotation was reported in conjunction with a copper sulfide ore for reducing the recovery of magnetic minerals (e.g., pyrrhotite and sulfide minerals locked with magnetite). The process used an electromagnet coil around a laboratory flotation column (Sonolikar et al., "Effect of magnetic field on column flotation of ore containing magnetic content", *Column Flotation* '88, SME Annual Meeting, Phoenix, Ariz., Jan. 25–28, 1988). In laboratory-scale tests, the use of electromagnets may be convenient in selectively varying the field strengths. However, for commercial-scale equipment, the use of an electromagnet is impractical with respect to size, design, and safety.

Further, in Seetharama et al. ("Effect of magnetic fields in the flotation of magnetic concentrates", *Investigation into Production of Iron Ore Concentrates with Less Than* 3 *Percent Silica from Minnesota Taconites*, Final Report to the State of Minnesota and the American Iron and Steel Institute, Mineral Resources Research Center, University of Minnesota, Minneapolis, Minn., 1991, 30 pages), a series of tests on magnetic taconite concentrates were carried out by applying magnetic fields to laboratory DENVER and WEMCO flotation cells.

In addition, Wu et al. ("The flotation of taconite in a magnetic field", *Proceedings, Minnesota Section SME* 68*th*

*Annual Meeting*, Center for Professional Development, University of Minnesota-Duluth, Duluth, Minn., 1995, pp. 245–256) tested the use of an electromagnet coil on a 203 mm (8-inch) diameter flotation column. Encouraged by preliminary test results, they extended the tests using permanent magnets around the flotation column and then in a 1.42 $m^3$ (50-cu.ft.) WEMCO flotation cell. In these tests, 12.7 mm (½-inch) thick magnetic sheets were placed facing each other vertically in the direction of an axis through the center of the flotation column. An aluminum frame held the sheets in place.

SUMMARY OF THE INVENTION

The present invention provides a separation apparatus for use in separating magnetic material from non-magnetic material that overcomes problems associated with conventional separation apparatus. The present invention also provides methods of separating magnetic material from non-magnetic material. The present invention uses a magnetic grid, e.g., a grid fabricated with strips of permanent magnetic sheets, with a proper configuration that provides adequate magnetic field strengths to prevent fine magnetic particles from passing through openings of the grid.

A method for separating magnetic material from non-magnetic material according to the present invention includes providing a container, and directing a slurry into the container through a slurry inlet. The slurry includes magnetic material and non-magnetic material. A medium is used to separate the magnetic material from the non-magnetic material. A portion of the magnetic material is transported with non-magnetic material along a path by at least the medium toward an overflow outlet. The method further includes positioning a magnetic grid defining a plurality of openings in the path of the transported magnetic material. The magnetic grid prevents at least a portion of the transported magnetic material from passing through the plurality of openings to the overflow outlet.

A separation apparatus for separating magnetic material from non-magnetic material according to the present invention includes a container. The container includes a slurry inlet configured to provide a slurry into the container and an overflow outlet. A magnetic grid is positioned in the container between the slurry inlet and the overflow outlet. The magnetic grid defines a plurality of openings. The magnetic grid is configured to generate a magnetic field in each opening of the plurality of openings.

A hydroseparator system for separating magnetic material from non-magnetic material according to the present invention includes a container extending along an axis from a lower region to an upper region. The container includes a slurry inlet configured to provide a slurry into the container, an overflow outlet located proximate the upper region of the container, an underflow outlet located proximate the lower region of the container configured to discharge separated magnetic material, and a fluid inlet configured to provide at least a liquid into the container. The liquid is used in separating the magnetic material from the nonmagnetic material. The hydroseparator system further includes a magnetic grid positioned in the container between the slurry inlet and the overflow outlet. The magnetic grid defines a plurality of openings and is used to generate a magnetic field in each opening of the plurality of openings.

A flotation system for separating magnetic material from non-magnetic material according to the present invention includes a container extending along an axis from a lower region to an upper region. The container includes a slurry inlet configured to provide a slurry into the container an overflow outlet located proximate the upper region of the container, an underflow outlet located proximate the lower region of the container configured to discharge magnetic material, and a gas inlet located proximate the lower region of the container. The gas inlet is configured to receive a gas. The flotation system further includes a bubble generation assembly positioned in the container. The bubble generation assembly is configured to generate a plurality of bubbles using the gas. Yet further, the flotation system includes a magnetic grid positioned in the container between the slurry inlet and the overflow outlet. The magnetic grid defines a plurality of openings and is used to generate a magnetic field in each opening of the plurality of openings.

In various embodiments, the container extends along an axis from a lower region to an upper region. The upper region is located proximate the overflow outlet.

Further, in various embodiments, the magnetic grid is positioned orthogonal to the axis. The magnetic grid may also preferably include a permanently magnetized grid. It may also be preferred that the magnetic field within each opening of the plurality of openings is of a strength to prevent at least a portion of the transported magnetic material from entering the overflow outlet. Yet further, the magnetic grid includes one or more layers of magnetic sheet strips that define the plurality of openings. The magnetic field in each opening of the plurality of openings may be controlled by increasing or decreasing the number of layers of magnetic sheet strips of the magnetic grid.

Further, in various embodiments, the apparatus of the present invention may also include an external magnetizing coil.

DETAILED DESCRIPTION OF ILLUSTRATIVE EMBODIMENTS OF THE INVENTION

The present invention shall be generally described with reference to FIG. 1. Various embodiments of the present invention shall thereafter be described with reference to FIGS. 2–6.

Among the advantages provided by the present invention is the ability to apply magnetic fields to various types of known separation apparatus to prevent magnetic material from being transported away with non-magnetic material during a separation process. Further, the present invention may allow for increased feed rates in separation apparatus.

While several previous attempts to apply magnetic fields to separation processes were unable to be scaled up for plant usage, the present invention can be used in large separation plants.

Figure 1:
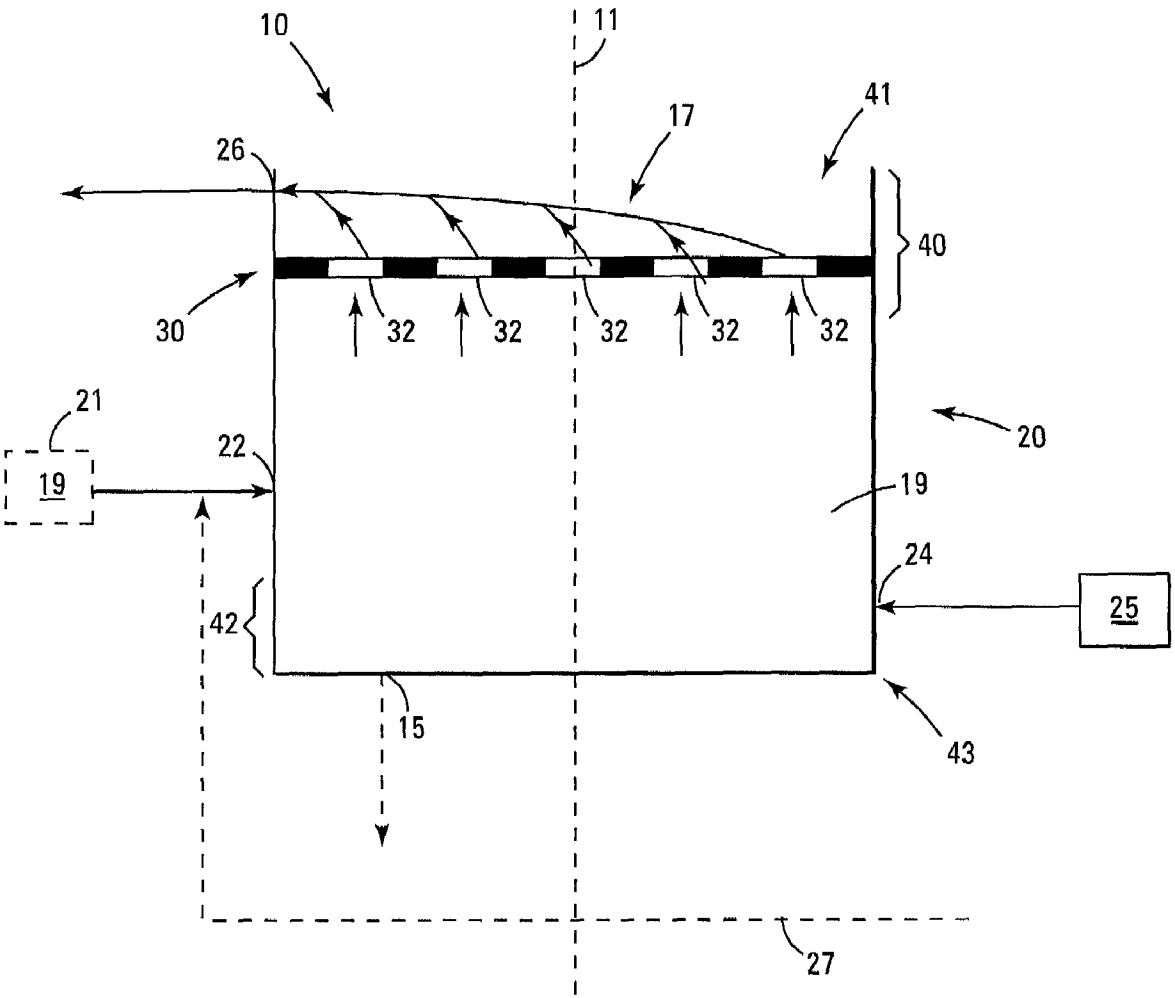
FIG. 1 is a schematic view of a separation apparatus according to the present invention.

FIG. 1 shows, generally, a separation apparatus 10 according to present invention designed to separate magnetic material from non-magnetic material where both materials are included in a slurry 19. Generally, the slurry 19 is provided to a container 20.

As used herein, a "slurry" is defined as a suspension of insoluble particles in a liquid. The liquids used according to the present invention may include water and/or any other liquids known in the art, such as those that aid in flocculation of magnetic materials. For example, other liquids may include, but are clearly not limited to, oils and oil/water emulsions, and aqueous solutions containing various organic and/or inorganic additives.

As also used herein, "magnetic material" is any material that is capable of being magnetized by a magnetic field. For example, magnetic materials in accordance with the present invention may include, but are clearly not limited to, magnetic minerals such as magnetite, pyrrhotite, maghemite, and various ferrites, as well as metals including iron, nickel, and cobalt.

"Non-magnetic material" is defined as material that is not magnetizable by a magnetic field. For example, non-magnetic materials according to the present invention may include, but are clearly not limited to, silica, silicate, carbonate, sulfide, phosphate minerals, and non-ferrous metals.

As depicted in FIG. 1, the separation apparatus 10 includes the container 20 for receiving the slurry 19 and a magnetic grid 30 positioned in the volume defined by the container 20. The container 20 includes a slurry inlet 22, a medium inlet 24, and an overflow outlet 26.

Although depicted generally in FIG. 1, the container 20 may be of any suitable shape known in the art. For example, the container may be a cylindrical tank, a cubic container, or any other structure defining a volume. Further, for example, the container 20 may be a structure that defines a volume as part of any known separation apparatus, e.g., hydroseparator, flotation cell, flotation column, as described in greater detail below. The container 20 further includes an upper region 40 at a first end 41 proximate the overflow outlet 26 of the container 20, and a lower region 42 at an opposing end 43 of the container 20. The container 20 extends from the lower region 42 to the upper region 40 along axis 11.

The slurry inlet 22 is configured to provide the slurry 19 from an external source 21, such as a feed pipe or feed well (not shown), into the container 20. The slurry 19 may include any magnetizable material combined with other non-magnetizable material, e.g., taconite wherein magnetite may be separable from siliceous gangue, waste containing magnetizable material wherein the magnetizable material may be separated from other non-magnetizable product and either disposed of or utilized separately therefrom, etc. Further, as previously described, the slurry 19 includes a liquid portion, such as for use in suspending the non-magnetizable material and/or used for transport. For example, the slurry 19 may include water. Further, the slurry 19 may include various other beneficial material or liquids, such as selective flocculation agents, including organic polymers (e.g., starches) and synthetic polymers.

The overflow outlet 26, located proximate the upper region 40 of the container 20, is configured to receive overflow from the container 20 as the container 20 is filled with, for example, the slurry 19 and/or other materials as described in greater detail below. For example, the overflow outlet 26 may take the form of an opening along the perimeter of the container at first end 41.

The medium inlet 24 is configured to provide a medium from an external source 25, e.g., feed pipe, into container 20. The medium may be any liquid or gas known in the art, for example, for washing and/or transporting slurry or portions thereof toward the overflow outlet 26. For example, in a hydroseparator process, the medium may preferably be a fluid including at least a liquid. Further, for example, in a flotation process, the medium may preferably be a gas. The medium inlet 24 may take the form of, e.g., a valved flow pipe. Alternatively, the medium may be mixed with the slurry 19 prior to the slurry 19 being provided by the slurry inlet 22 into the container 20 as shown by the dashed line 27.

The magnetic grid 30 defines a plurality of openings 32. Preferably, the magnetic grid 30 is positioned in container 20 of the separation apparatus 10 between the slurry inlet 22 and the overflow outlet 26 such that the magnetic grid 30 is substantially orthogonal to an axis 11. However, the grid 30 may be at any other angle relative to axis 11, if the flow to the overflow outlet 26 is not substantially impeded. Further, preferably the magnetic grid 30 substantially covers the entire cross-sectional area of container 20.

Figure 2A:
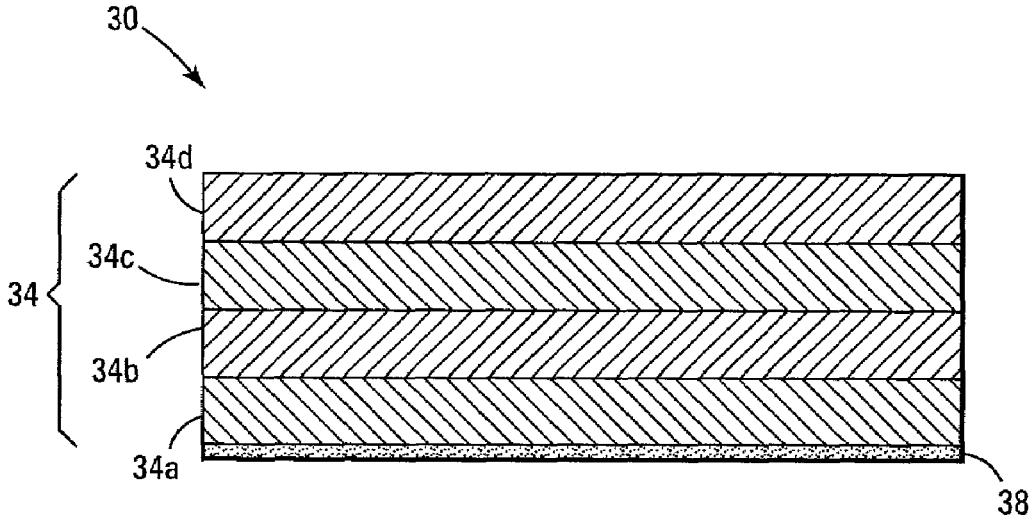
FIG. 2A is a cross-section view of a portion of a magnetic grid of the separation apparatus of FIG. 1.

One illustrative embodiment of the magnetic grid 30 of FIG. 1 will be described in greater detail with reference to FIGS. 2A–2D. FIG. 2A depicts an illustrative cross-section of magnetic grid 30. As illustrated, the magnetic grid 30 includes layers 34*a*–34*d* (collectively layers 34) of magnetic sheet material, e.g., magnetic sheet strips. Although FIG. 2A illustrates four layers 34*a*–34*d* of magnetic sheet material, the magnetic grid 30 may include any number of layers. The magnetic grid 30 may also include a support structure, e.g., a steel sheet 38 for the layers 34 of magnetic sheet material. However, the magnetic sheet material may provide itself with adequate support.

Preferably, magnetic sheet material, e.g., magnetic sheet strips, include permanently magnetic sheet material. The magnetic grid 30 may be made of any suitable permanently magnetic sheet material known in the art, such as bonded rare earth magnets (e.g., flexible magnetic sheets or strips).

Each layer 34*a*–34*d* of magnetic grid 30 may preferably include a thickness in the range of ⅛ inch to 1 inch. As further described below, use of multiple layers of permanently magnetic sheet material provides for the advantage of adjustment of the magnetic field in openings 32 of the grid 30 by adding and/or removing layers 34.

Figure 2B:
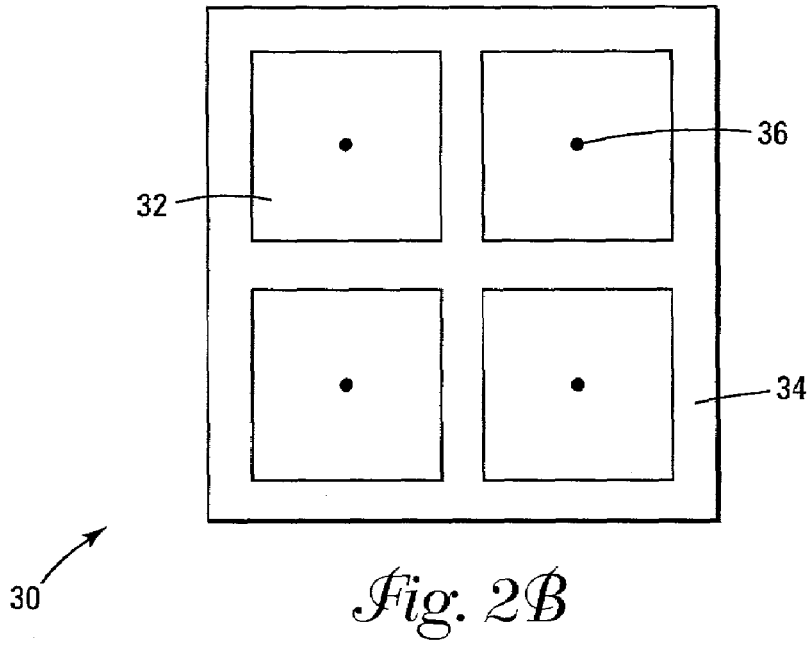
FIG. 2B is a plan view of a portion of the magnetic grid of the separation apparatus of FIG. 1.

FIG. 2B illustrates a plan view of a portion of the magnetic grid 30. The configuration of the layer 34 of the magnetic grid 30 defines openings 32. Each opening 32 defines a center 36. Although depicted as square, the cross-section of the openings 32 orthogonal to axis 11 of magnetic grid 30 may be any suitable shape, e.g., rectangular, hexagonal, circular, etc.

Figure 2C:
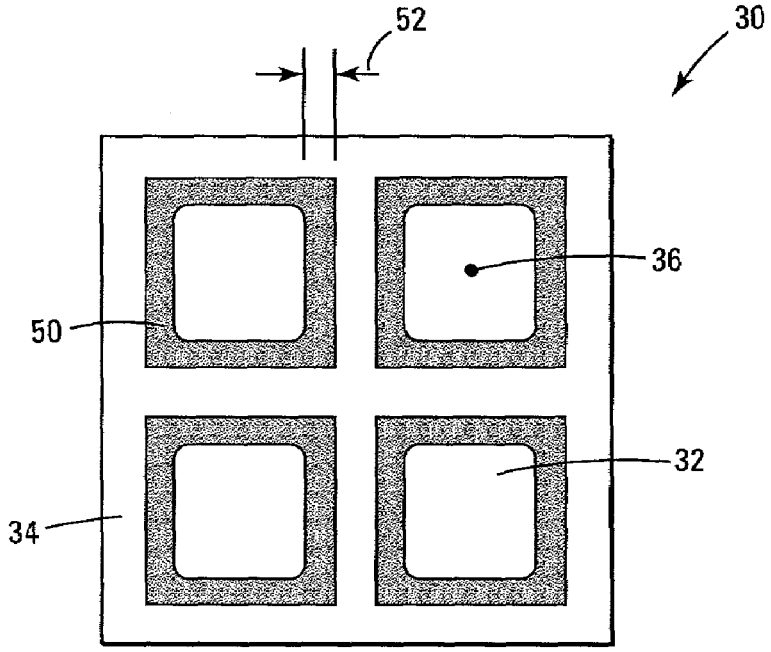
FIG. 2C is a plan view of a coated portion of the magnetic grid of the separation apparatus of FIG. 1.

As further described below, portions of the slurry 19 pass through the magnetic grid 30 toward the overflow outlet 26 (see arrows 17 of FIG. 1). At the beginning of the separation process, a portion of magnetic material 50 in slurry 19 will be attracted to and coat a portion of the magnetic grid 30 as illustrated in FIG. 2C. The portion of magnetic material 50 coats the portion of the magnetic grid 30 to a certain thickness 52. Such thickness 52 will depend on various factors, including the strength of the magnetic field generated by the grid, the shape of the corners of each opening 32, the magnetic properties of the magnetic materials in the slurry 19, and the size of the magnetic material particles in slurry 19. Although the magnetic material coating 50 may reduce the magnetic field in each opening 32, the magnetic field is still of a sufficient strength to prevent at least a portion of magnetic material from passing through the magnetic grid 30 toward the overflow outlet 26.

Figure 2D:
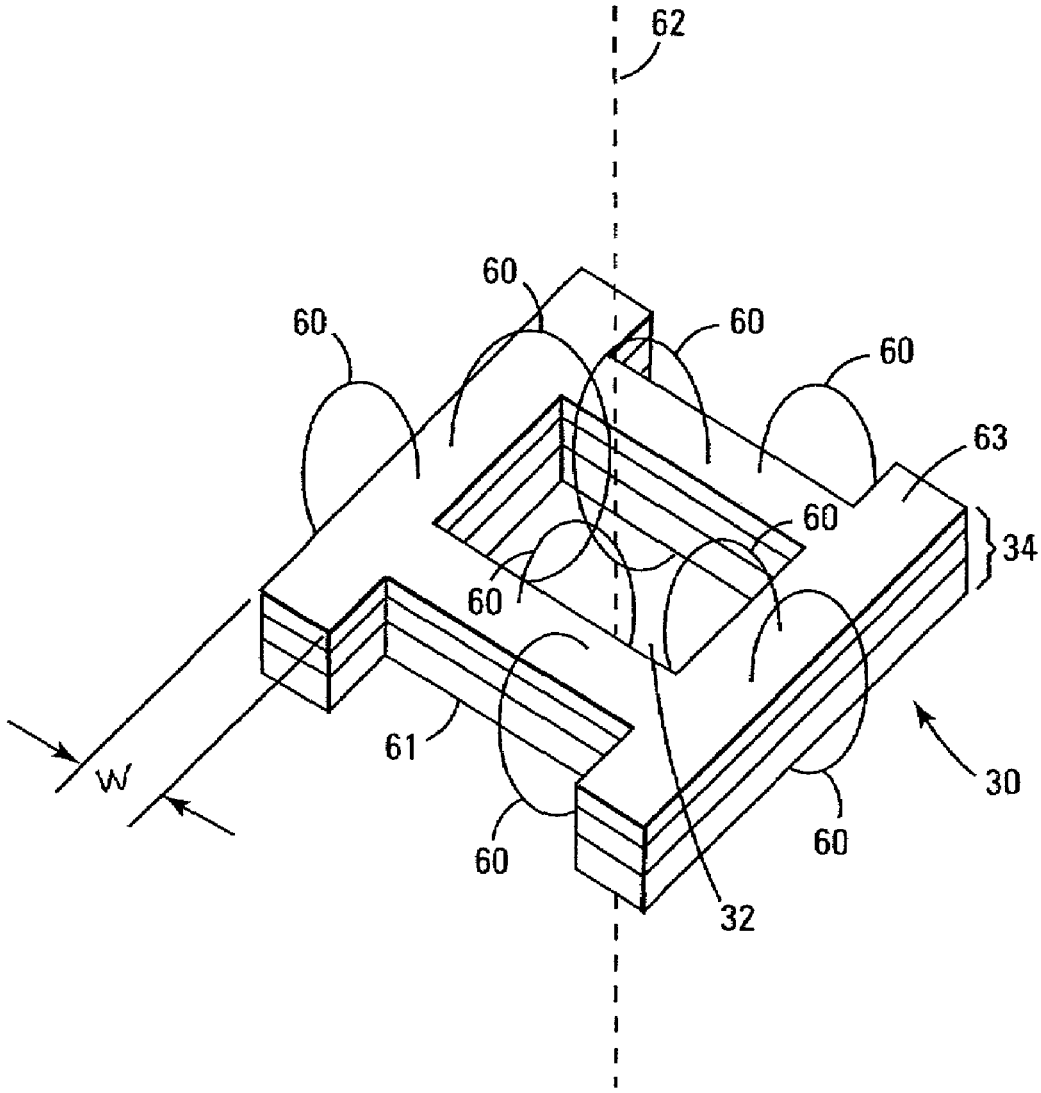
FIG. 2D is a perspective view of a portion of the magnetic grid of the separation apparatus of FIG. 1.

FIG. 2D illustrates a perspective view of a portion of the magnetic grid 30. As depicted, the magnetic grid 30 includes layers 34 defining opening 32. The opening 32 is defined along axis 62 and from lower surface 61 to upper surface 63 of the grid 30. The opening 32 can be of any suitable cross-sectional shape as previously described, e.g., square, rectangular, hexagonal, circular, oval, etc. The size of each opening 32 is preferably such that the flow of non-magnetic material and medium being transported to the overflow outlet 26 is not substantially impeded. Preferably, the openings are kept as large as possible. In other words, the amount of permanent magnetic sheet material is kept to a minimum. For example, in one illustrative embodiment, the width (w) of each magnetic strip that forms layers 34 is kept to a minimum while still providing a strong enough magnetic field at the center 36 of openings 32. Preferably, the width of each strip is in the range of ¼ inch to 2 inches. Of course, such width will depend on the properties of the permanently magnetic sheet material of the grid 30, the size of the openings 32, the number of layers 34, the thickness of each layer 34, and the width of each strip. The square grid pattern also assists in minimizing the impedance on material flow through the opening 32 while maintaining a strong enough magnetic field at the center of the opening 32.

A magnetic field in each opening 32 represented by magnetic field lines 60 shown in FIG. 2D is generated by the layers 34 of the magnetic grid 30. As magnetic material in the slurry approaches the magnetic grid 30, the magnetic field generated by the grid 30 prevents at least a portion magnetic material from completely passing through opening 32.

While not wishing to be bound by any particular theory, one illustrative separation process using the separation apparatus 10 is described with reference to FIG. 1 for separating magnetic material from non-magnetic material. Generally, with the slurry 19 provided via slurry inlet 22 and a transport medium, e.g., water, such as in a hydroseparator, or air, such as in a flotation column, also provided to the container, heavier flocculated particles (i.e., flocs) of magnetic material either remain suspended in slurry 19 (e.g., flotation column) or settle to the lower region 42 of container 20 (e.g., hydroseparator). Lighter particles of magnetic material, e.g., fine magnetite particles, on the other hand, may get undesirably trapped in flocs with non-magnetic material. These flocs may tend to float to the surface along with at least the transport medium on a path to the overflow outlet 26 as more slurry 19 and transport medium are received by the container 20.

To prevent these lighter particles of magnetic material from being lost in the overflow and removed from the container 20 at the overflow outlet 26, the magnetic grid 30 of the present invention prevents at least a portion of the magnetic material that has been transported toward the overflow outlet 26 from passing through the plurality of openings 32 of the magnetic grid 30. As mentioned above, a portion of the magnetic material may be undesirably transported upward toward the overflow outlet 26 and coat at least a portion of the magnetic grid 30 (see FIG. 2C). After the grid 30 has reached its maximum coating thickness, the remainder of the transported magnetic material may be suspended below the magnetic grid 30 as non-magnetic material and transport medium continue to flow through the plurality of openings 32 of the magnetic grid 30 toward the overflow outlet 26. Some of such magnetic material may also settle to the lower region 42 of the container 20.

The magnetic material that settles to lower region 42 of the container 20 can be discharged from container 20 via optional underflow outlet 15, or by way of any other technique, such as use of an underflow discharge pump, an overflow stand pipe, and/or a weir.

Figure 3:
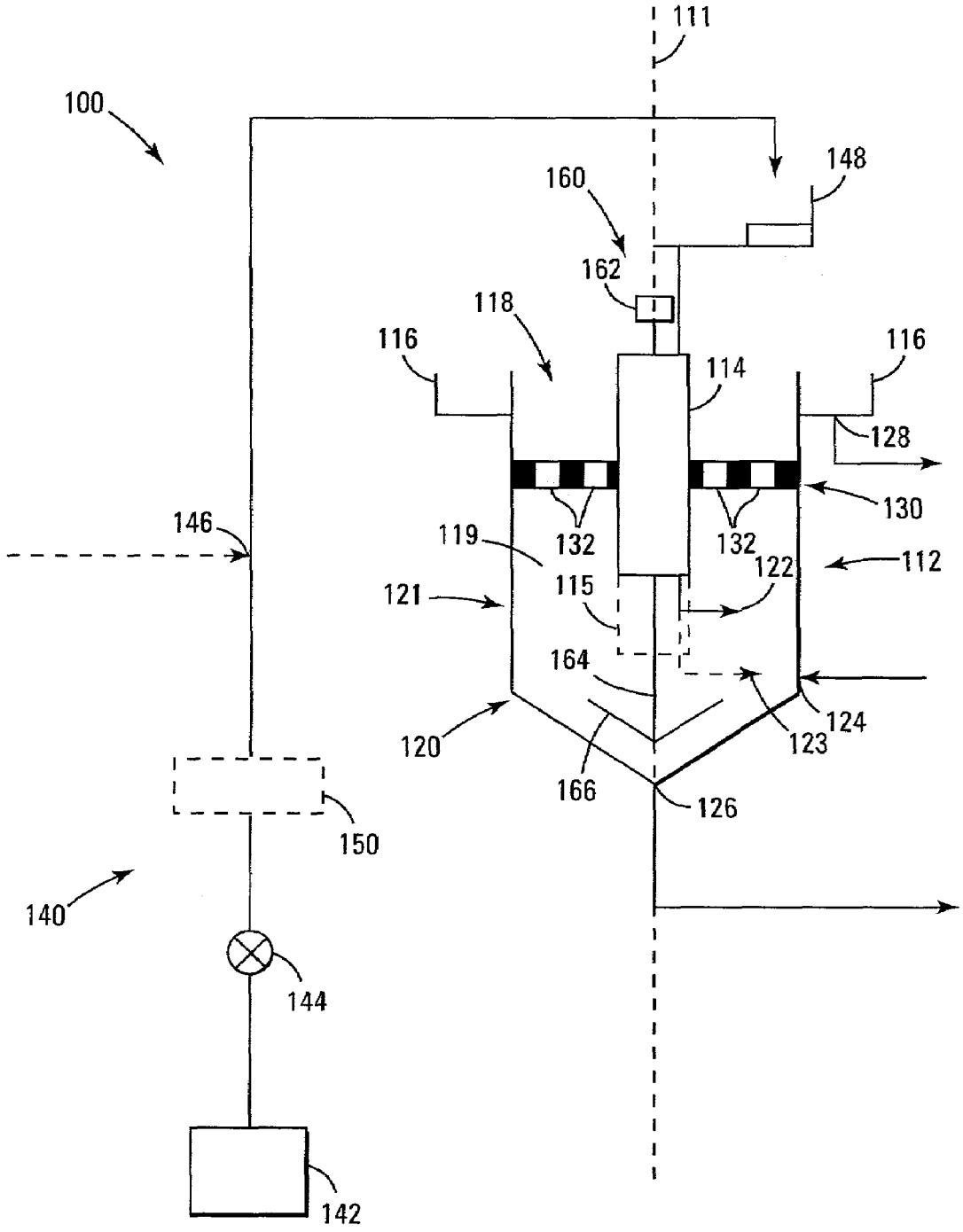
FIG. 3 is a schematic view of one illustrative embodiment of a hydroseparator system using a magnetic grid according to the present invention.
Figure 4:
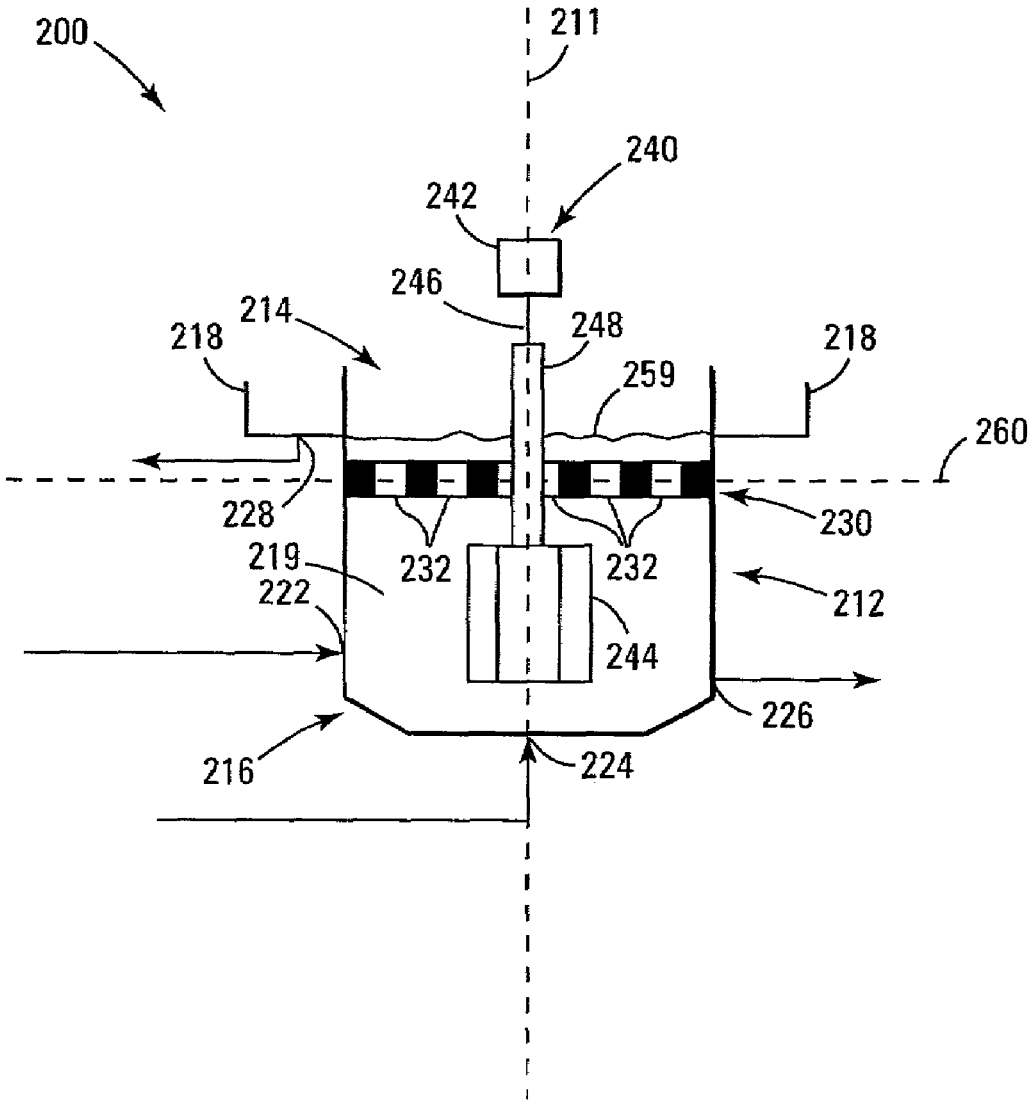
FIG. 4 is a schematic view of one illustrative embodiment of a flotation cell system according to the present invention.
Figure 5:
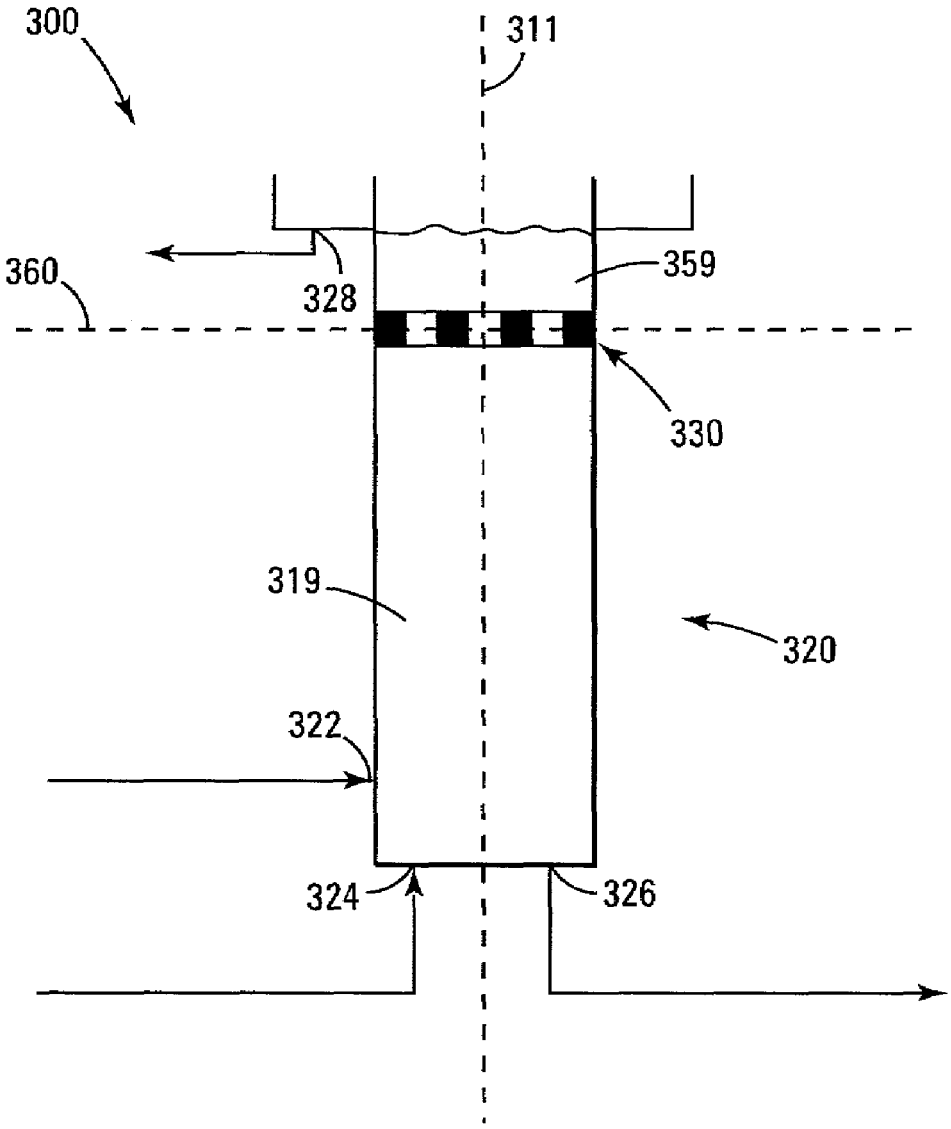
FIG. 5 is a schematic view of one illustrative embodiment of a flotation column system according to the present invention.

The magnetic grid of the present invention may be useful in a variety of separation systems. For example, the magnetic grid may be used in, e.g., a hydroseparator system 100 as shown in FIG. 3, a flotation cell system 200 as shown in FIG. 4, or a flotation column system 300 as shown in FIG. 5. The description provided for such systems is summarized below for simplicity. One skilled in the art would recognize that any type of separation apparatus, such as a hydroseparator system or a flotation system, may be modified with the magnetic grid techniques described herein.

As depicted in FIG. 3, the illustrative hydroseparator system 100 includes a container 112, a magnetic grid 130, a feed apparatus 140, and rotor assembly 160. Any suitable hydroseparator system known in the art may employ the present invention. For example, suitable hydroseparator systems include, but are clearly not limited to, hydroseparators, classifiers, thickeners, monosizers, and siphon sizers.

The container 112 extends from a lower region 120 to an upper region 118 along axis 111. Overflow lips 116 are located proximate the upper region 118 of container 112. Container 112 also includes an overflow outlet 128 located proximate the upper region 118, and a fluid inlet 124. The fluid inlet 124 is configured to provide at least a liquid into the slurry 119 in container 112 where the liquid is used in separating magnetic material from non-magnetic material. The fluid inlet 124 may be located proximate the lower region 120, a middle region 121, or upper region 118 of container 112. The liquid or liquids provided by fluid inlet 124 are further described below.

Further, a slurry inlet 122 is in fluid communication with the feed apparatus 140 through a feed well 114 that is located proximate the center of container 112 along axis 111. The slurry inlet 122 is configured to provide a slurry 119 from the feed apparatus 140 and distribute the slurry 119 into the container 112. The slurry inlet 122 may be positioned in container 112 proximate a middle region 121 of container 112, proximate the lower region 120 of container 112 (as depicted in FIG. 3 as slurry inlet 123 and feed well 115), or proximate upper region 118 of container 112. Preferably, the slurry inlet 122 is positioned such that the magnetic grid 130 is located between the slurry inlet 122 and the overflow outlet 128.

Container 112 also includes an underflow outlet 126. As depicted, the underflow outlet 126 is located proximate the lower region 120 of container 112. The underflow outlet 126 is configured to discharge underflow magnetic material that settles out of the slurry 119 as the slurry 119 is provided into the container 112 by the slurry inlet 122 during operation of the separation process.

The feed apparatus 140 may include any number of different components, including, but clearly not limited to, a pump 142, a valve 144, and a constant head tank 148. Any suitable feed apparatus known in the art may be used to control and feed slurry 119 into container 112.

Preferably, the feed apparatus 140 includes a magnetizing coil 150 that magnetizes the slurry 119 before the slurry 119 is fed into container 112. The magnetizing coil 150 may be any suitable device known in the art capable of producing a magnetic field such that the magnetic field is capable of magnetizing magnetic material in slurry 119. Preferably, the magnetizing coil 150 is an electromagnet that generates a magnetic field having a field strength in the range of 50 gauss up to 350 gauss. One will recognize that the magnetizing coil 150 can be used with any separation embodiment described herein.

The feed apparatus 140 may also include an external fluid inlet 146, which is configured to provide at least a liquid into the slurry 119 before the slurry 119 is provided into the container 112. Liquid may be provided into the slurry by external fluid inlet 146, fluid inlet 124, or by both fluid inlets. The liquid, one type of medium used for separation of magnetic material from non-magnetic material, may be any suitable liquid or liquids known in the art capable of aiding in separation and/or transportation of the non-magnetic material contained in the slurry from the lower region 120 of container 112 toward the overflow outlet 128, such as water, oil, and oil/water emulsions, and aqueous solutions containing various organic and/or inorganic additives. Further, the liquid may include various flocculants that aid in flocculating the non-magnetic material in the slurry that are known in the art, e.g., natural and synthetic polymers, that are capable of inducing selective flocculation of valuable non-magnetic material with magnetic material.

The hydroseparator system 100 may also include rotor assembly 160. In one illustrative embodiment, the rotor assembly 160 includes a motor 162, a shaft 164 operatively connected to the motor 162, and a rake 166 operatively connected to the motor via shaft 164. The rotor assembly 160 may aid in compacting and/or transporting the sedimented slurry towards underflow outlet 126.

In operation, slurry 119 is fed through the magnetizing coil 150 to magnetize the magnetizable material therein, or to provide for stronger magnetization characteristics, and provided into the constant head tank 148. For example, the field strength of the magnetizing coil may preferably be in the range of 50 gauss to 350 gauss.

The rate of flow of the slurry 119 into the container 112 is controlled by at least one valve 144. For example, for a 3 foot diameter pilot plant hydroseparator, the feed rate of the slurry 119 being fed into container 112 is preferably at least 113 L/min (30 gpm); more preferably greater than 303 L/min (80 gpm). Even more preferably, the feed rate is greater than 380 L/min (100 gpm).

The magnetic grid 130 may be similar to magnetic grid 30 as described above in reference to FIG. 1 and FIGS. 2A–2D. The magnetic grid 130 is positioned proximate the upper region 118 of container 112 in between the slurry inlet 122 and the overflow outlet 128. In other words, when the container 112 is full, the grid 130 is positioned in the slurry 119 being processed. Further, the magnetic grid 130 may be positioned such that it is substantially orthogonal to axis 111. Preferably, the grid 130 is positioned such that it is in the slurry 119 when the container 112 is full and just slightly below the level of the overflow outlet 128. For example, the grid 130 may be positioned at a level that is preferably 1 inch to 12 inches below the overflow outlet level at which overflow starts, and more preferably 3 to 6 inches below such a level.

The underflow outlet 126 is operable to selectively control the percentage of solids of the underflow discharged from container 112 (i.e., the slurry density). As the slurry 119 is provided into container 112 via slurry inlet 122, certain components of the slurry 119 will have an upward velocity, mostly in the direction of axis 111, on a path toward overflow outlet 128, which is dependent, at least in part, on the feed rate of the slurry 119, the feed rate of the liquid (as provided by, e.g., fluid inlet 124 and/or fluid inlet 146), an underflow rate, and the density of the slurry 119. The upward velocity is preferably as great as the apparatus will allow while still preventing less than a certain portion (e.g., less than 1% magnetic iron) magnetic material from passing through the openings 132. For example, the upward velocity may be preferably greater than 303 L/min (80 gpm), and more preferably greater than 380 L/min.

As components are transported toward the overflow outlet 128 through the plurality of openings 132 of magnetic grid 130, at the start of the separation process at least a portion of the magnetic grid 130 is coated with a portion of magnetic material from the slurry 119 (see FIG. 2C), e.g., fine particles that have not settled to lower region 120, those particles trapped by non-magnetic material having lesser density, e.g., fine magnetite particles, etc. However, the coating does not inhibit the magnetic grid 130 (i.e., the magnetic field generated thereby) from preventing at least a portion of the transported magnetic material from reaching the overflow outlet 128, e.g., preventing the transported magnetic material from passing through the plurality of openings 132 defined by grid 130.

After the grid 130 has been coated with magnetic material to a certain thickness, the remainder of magnetic material that has been undesirably transported toward the overflow outlet 128 either remains suspended below the magnetic grid 130 or settles toward lower region 120. Preferably, less than 1% of the magnetic material undesirably transported towards the overflow outlet 128 completely passes through the magnetic grid 130 and is received by the overflow outlet 128.

Further, once a batch of slurry has passed through the container 112, the remaining magnetic material that is coating the magnetic grid 130 and the magnetic material that is suspended below the magnetic grid 130 may eventually settle to the lower region 120 of container 112 where it may be removed from container 112 by the underflow outlet 126 using, e.g., an underflow discharge pump.

In general, plants that operate hydroseparators have varying operation strategies that are dependent on the desired outcome. For example, some plants are more concerned with recovery of magnetic material, and, therefore, operate hydroseparators at lower upward velocities such that a smaller percentage of magnetic material may be lost in the overflow. Other plants place more importance on separating magnetic material from non-magnetic material as efficiently as possible, thereby compromising recovery of magnetic material by increasing the slurry feed rate or other component feed rates that generally increase the overflow rate.

For example, in reference to magnetic iron recovery, plants tend to indicate that 35% to 65% of silica in the fine (−25 $\mu$m or −500 mesh) size fraction is separated from the magnetic concentrate by hydroseparators. These figures correlate with typical upward velocities within hydroseparators that vary between 1.7 and 3.2 mm/sec (0.07 and 0.13 inch/sec). A higher upward velocity provides more effective separation of fine silicate minerals, but increases magnetic iron losses within a range from 0.05 to 1.5% relative to the concentration of magnetic iron material in a feed slurry.

One of the advantages of the present invention is that higher upward velocities can be utilized while maintaining lower magnetic iron losses. As mentioned above, the effectiveness of separation in a hydroseparator is dependent on at least the upward velocity of the slurry and the liquid used to transport the slurry upward toward the overflow outlet. In turn, upward velocity is mainly dependent on four factors: 1) underflow rate, 2) slurry feed rate, 3) liquid feed rate, and 4)

slurry density. The underflow rate is controlled by the slurry density at which the underflow outlet 126 is configured to discharge underflow from container 112. The slurry density is the percentage of solids in the slurry 119. By utilizing the present invention, upward velocities may be increased appreciably over the current practice by applying a magnetic field using the magnetic grid 130 as described herein, while maintaining lower magnetic material losses.

The magnetic grid of the present invention may also be incorporated into flotation separation systems known in the art. Any type of flotation system may be modified with a magnetic grid technique described in accordance with the present invention, e.g., mechanical flotation cells such as those made by WEMCO, DENVER, or GALLIGHER, column flotation cells, or pneumatic flotation cells.

For example, FIG. 4 shows a schematic view of an illustrative flotation cell system 200 according to the present invention. The system 200 includes a container 212, a magnetic grid 230 positioned within the volume defined by the container 212, and a bubble generation assembly 240 proximate the center of the container 212 along axis 211.

The container 212 extends from a lower region 216 to an upper region 214 along axis 211. The container 212 further includes a slurry inlet 222 located proximate the lower region 216. The slurry inlet 222 is configured to provide a slurry 219 containing at least magnetic and non-magnetic material into container 212. An underflow outlet 226, located proximate the lower region 216 of container 212, is configured to discharge underflow, including flocculated magnetic material that is not transported by a plurality of bubbles as the separation process proceeds. An overflow outlet 228 is located proximate the upper region 214 of container 212 with an overflow lip 218. The overflow outlet 228 is configured to receive overflow from the container 212, including non-magnetic material, when the separation process is operational.

The container 212 may also include a gas inlet 224 that is configured to receive a gas. The gas may be any suitable gas, preferably air or nitrogen.

Magnetic grid 230 is located proximate the upper region 214 of the container 212. The position is preferably determined by assessing a slurry/froth boundary 260 of the flotation system when operational, with the grid 230 preferably positioned proximate the boundary 260.

The magnetic grid 230 defines a plurality of openings 232 that allow non-magnetic material to pass through to the overflow outlet 228. As previously described in reference to FIGS. 2A–2D, the magnetic grid 230 may include a plurality of layers (e.g., layers 34) of magnetic sheet strips that are formed such that the cross-sections of openings 232 defined by the layers are in any suitable shape known in the art. The magnetic grid 230 generates a magnetic field having field lines that run through each opening of the plurality of openings 232 (see FIG. 2D).

The bubble generation assembly 240 of flotation cell system 200 includes a motor 242, a shaft 246, a rotor 244, and an air intake 248. The shaft 246 operatively connects the motor 242 to the rotor 244 via shaft 246 through air intake 248 such that the motor 242 causes the rotor 244 to rotate at a controllable rate. The bubble generation assembly 240 is configured to keep the slurry 219 in suspension and to break up the plurality of bubbles created when a gas (e.g., air) is provided into the container 212 by the gas inlet 224. Alternatively, operation of the bubble generation assembly 240 acts to draw air into air intake 248 where it is broken up by the rotor 244. By breaking up the bubbles, more, smaller, bubbles are created, thereby increasing the amount of bubble surface area for floatable particles to adhere to.

Flotation, at least in part, is based on the fact that some of the components of the slurry that are crushed and ground are wettable by water (hydrophilic), whereas other components are made water-repellent (hydrophobic) by the addition of a reagent known as a flotation collector. The hydrophobic particles have an ability to attach to air bubbles by surface action, the nature of the film on the outside of the particles being the controlling factor. When air is introduced into the slurry 219, the hydrophobic particles adhere to the plurality of the resultant air bubbles. This action causes the particles attached to the plurality of bubbles to rise to the surface of the container 212. There they collect in a mass of froth 259 and eventually overflow through the overflow outlet 228.

In operation, slurry 219 is fed into container 212 through slurry inlet 222. The slurry 219 from which hydrophobic particles are removed is discharged from container 212 by underflow outlet 226.

As slurry 219 is fed into container 212, gas (e.g., air) is also fed into container 212 either through either gas inlet 224 or air intake 248. As the gas enters the slurry 219 in container 212, the gas forms a plurality of bubbles. Bubble generation assembly 240 breaks the bubbles into smaller bubbles, thus increasing the total bubble surface area. Non-magnetic material and some magnetic material attach to the plurality of bubbles and are transported toward the overflow outlet 228. In other words, the plurality of bubbles move toward the surface of the slurry 219 open to the atmosphere. For example, the non-magnetic material attaches to the plurality of bubbles and is transported to the surface. However, some of the smaller or finer particles of magnetic material are also attached to the plurality of bubbles with the non-magnetic material and are undesirably transported to the surface of the slurry 219.

To prevent magnetic material from being transported by the plurality of bubbles to the froth 259, the present invention positions the magnetic grid 230 in the path of the transported material. Preferably, the magnetic grid 230 is placed at a boundary 260 that is defined between the froth 259 and the remaining slurry 219. As such, at least a portion of the magnetic material is prevented from passing through the plurality of openings 232 of magnetic grid 230 by a sufficiently large magnetic field. Preferably, the field at the center of each opening 232 is strong enough to prevent magnetic material from passing therethrough. Further, it may be preferred that the magnetic grid 230 be positioned within the container 212 such that the magnetic grid 230, or cross-sections of openings 232, are substantially orthogonal to axis 211. Further, preferably the magnetic grid 230 substantially covers the entire cross-sectional area of container 212.

Although any configuration and type of permanent magnetic material that provides suitable magnetic fields at the center of the openings 232 may be used, in one illustrative embodiment, the magnetic grid 230 may preferably include strips of magnetic sheet that are ¼ inch to 2 inches wide. Each opening of the plurality of openings 232 may be of various sizes and shapes. Further, a plurality of layers of magnetic sheet strips may be laid on a steel gridwork. Preferably, for a WEMCO flotation cell having an inside dimension of 1.27×1.71 m (50 inches by 67.5 inches), a gridwork having 203 mm (8-inch) openings with 25.4 mm (1-inch) wide magnetic sheet strips provide a sufficient number of openings 232 with sufficient field strengths to prevent a portion of transported magnetic material from passing through the grid 230 toward the overflow outlet 228.

As discussed above in reference to the embodiment depicted in FIG. 3, the magnetic grid 230 may become coated with magnetic material during at least a time at the start of the separation process. However, the coating does not inhibit the magnetic field produced by the magnetic grid 230 from preventing transported magnetic material from passing through the plurality of openings 232.

As also described in reference to FIG. 3, the slurry 219 may be magnetized prior to entering container 212 by a magnetizing coil (not shown).

FIG. 5 depicts another illustrative embodiment of a flotation separation apparatus in the form of a flotation column system 300 according to the present invention. In many respects, the flotation column system 300, and operation thereof, is similar to the flotation cell system 200 of FIG. 4. The system 300 includes a container 320 and a magnetic grid 330. The magnetic grid 330 may also be placed at a boundary 360 defined between froth 359 and slurry 319. The flotation column system 300 also includes a slurry inlet 322, a fluid inlet 324, an underflow outlet 326, and an overflow outlet 328.

At least one difference between the flotation column system 300 and the flotation cell system 200 is that the flotation column system 300 does not include a bubble generation assembly. Further, the flotation column system 300 has a longer, more slender container shape extending along axis 311.

Figure 6:
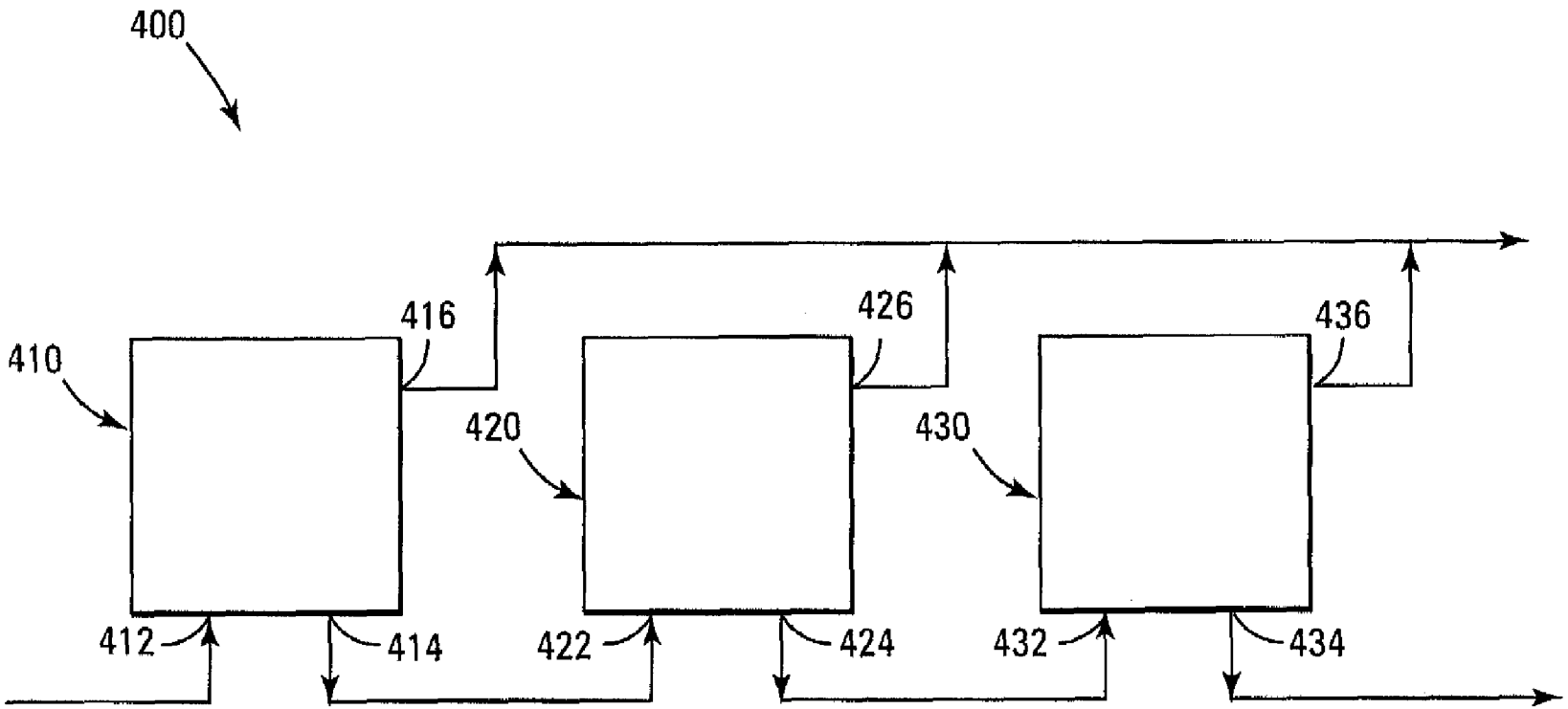
FIG. 6 is a block diagram of a multiple separation apparatus system according to the present invention.

Any separation apparatus using a magnetic grid as described herein may be implemented in a configuration as shown in FIG. 6. As illustrated in FIG. 6, separation apparatus 410, 420, and 430 may be placed in fluid communication to further separate magnetic material from non-magnetic material. As depicted, separation apparatus 410 includes a slurry inlet 412, an underflow outlet 414, and an overflow outlet 416. The underflow outlet 414 is in fluid communication with separation apparatus 420 through slurry inlet 422. Separation apparatus 410 processes the slurry in accordance with the present invention and directs overflow through overflow outlet 416 and underflow through underflow inlet 414 into slurry inlet 422 of separation apparatus 420. The separation apparatus 420 then processes the slurry in accordance with the method described above. The underflow from separation apparatus 420 is then transported through underflow outlet 424 to slurry inlet 432 of separation apparatus 430. Although three separation apparatus are depicted in FIG. 6, the present invention may include any number of separation apparatus operatively connected together.

All references and publications cited herein are expressly incorporated herein by reference in their entirety into this disclosure. Illustrative embodiments of this invention are discussed and reference has been made to possible variations within the scope of this invention. These and other variations and modifications in the invention will be apparent to those skilled in the art without departing from the scope of this invention, and it should be understood that this invention is not limited to the illustrative embodiments set forth herein. Accordingly, the invention is to be limited only by the claims provided below.

What is claimed is:

1. A method for separating magnetic material from non-magnetic material, the method comprising:

providing a container, wherein the container extends along an axis from a lower region to an upper region;

directing a slurry into the container through a slurry inlet, wherein the slurry comprises magnetic material and non-magnetic material;

using at least a medium to separate the magnetic material from the non-magnetic material, wherein a portion of the magnetic material is transported with non-magnetic material along a path by at least the medium toward an overflow outlet, wherein the overflow outlet is located proximate the upper region;

positioning a magnetic grid defining a plurality of openings in the path of the transported magnetic material, wherein the magnetic grid prevents at least a portion of the transported magnetic material from passing through the plurality of openings to the overflow outlet; and discharging separated magnetic material via an underflow outlet located proximate the lower region of the container during separation of magnetic material from the non-magnetic material.

2. The method according to claim 1, wherein the magnetic grid is positioned orthogonal to the axis.

3. A method for separating magnetic material from non-magnetic material, the method comprising:

providing a container;

directing a slurry into the container through a slurry inlet, wherein the slurry comprises magnetic material and non-magnetic material;

using at least a medium to separate the magnetic material from the non-magnetic material, wherein a portion of the magnetic material is transported with non-magnetic material along a path by at least the medium toward an overflow outlet; and positioning a magnetic grid defining a plurality of openings in the path of the transported magnetic material, wherein the magnetic grid prevents at least a portion of the transported magnetic material from passing through the plurality of openings to the overflow outlet, wherein the magnetic grid comprises a permanently magnetized grid.

4. The method according to claim 1, wherein the magnetic grid generates a magnetic field within each opening of the plurality of openings, and further wherein the magnetic field within each opening of the plurality of openings is of a strength to prevent at least a portion of the transported magnetic material from entering the overflow outlet.

5. The method according to claim 1, wherein the magnetic grid comprises one or more layers of magnetic sheet strips defining the plurality of openings.

6. The method according to claim 5, wherein the method further comprises controlling the magnetic field in each opening of the plurality of openings by increasing or decreasing the number of layers of magnetic sheet strips of the magnetic grid.

7. The method according to claim 1, wherein each opening of the plurality of openings in the magnetic grid comprises a rectangular shape.

8. The method according to claim 7, wherein each opening of the plurality of openings in the magnetic grid comprises a square shape.

9. The method according to claim 1, wherein the method further comprises coating at least a portion of the magnetic grid with a portion of the transported magnetic material.

10. The method according to claim 1, wherein the magnetic material comprises a plurality of magnetite particles, wherein the magnetic grid prevents at least a portion of the magnetite particles from entering the overflow outlet, and further wherein at least a portion of the plurality of magnetite particles prevented from entering the overflow outlet comprises a particle diameter that is less than or equal to 25 $\mu$m.

11. A method for separating magnetic material from non-magnetic material, the method comprising:

providing a container, wherein at least the container is a component of a hydroseparator system, wherein the container extends along an axis from a lower region to an upper region;

directing a slurry into the container through a slurry inlet, wherein the slurry comprises magnetic material and non-magnetic material;

using at least a medium to separate the magnetic material from the non-magnetic material, wherein a portion of the magnetic material is transported with non-magnetic material along a path by at least the medium toward an overflow outlet, and positioning a magnetic grid defining a plurality of openings in the path of the transported magnetic material, wherein the magnetic grid prevents at least a portion of the transported magnetic material from passing through the plurality of openings to the overflow outlet, wherein the overflow outlet is located proximate the upper region, wherein the hydroseparator system further comprises an underflow outlet located proximate the lower region of the container for discharging separated magnetic material, and further wherein using the medium to separate the magnetic material from the non-magnetic material comprises using at least a liquid as the medium to separate the magnetic material from the non-magnetic material.

12. The method according to claim 11, wherein positioning the magnetic grid further comprises positioning the magnetic grid within the slurry in the container.

13. The method according to claim 1, wherein the medium comprises at least one of a gas or a liquid.

14. The method according to claim 1, wherein the method further comprises mixing the slurry with the medium before the slurry is directed into the container.

15. The method according to claim 1, wherein the method further comprises:

providing an external magnetizing coil; and directing the slurry through the external magnetizing coil before the slurry is directed into the container.

16. A method for separating magnetic material from non-magnetic material, the method comprising:

providing a container, wherein at least the container is a component of a flotation system, wherein the container extends along an axis from a lower region to an upper region;

directing a slurry into the container through a slurry inlet, wherein the slurry comprises magnetic material and non-magnetic material;

using at least a medium to separate the magnetic material from the non-magnetic material, wherein a portion of the magnetic material is transported with non-magnetic material along a path by at least the medium toward an overflow outlet; and positioning a magnetic grid defining a plurality of openings in the path of the transported magnetic material, wherein the magnetic grid prevents at least a portion of the transported magnetic material from passing through the plurality of openings to the overflow outlet, wherein the overflow outlet is located proximate the upper region, wherein the flotation system further comprises an underflow outlet located proximate the lower region of the container for discharging separated magnetic material, and further wherein using the medium to separate the magnetic material from the non-magnetic material comprises using a gas as the medium to separate the magnetic material from the non-magnetic material.

17. The method according to claim 16, wherein the method further comprises bubbling the gas to generate a plurality of bubbles, wherein the portion of magnetic material and at least a portion of non-magnetic material is transported toward the upper region of the container by the plurality of bubbles.

18. The method according to claim 17, wherein bubbling the gas generates a froth proximate the upper region of the container, and further wherein the froth defines a boundary with the slurry in the container, wherein positioning the magnetic grid further comprises positioning the magnetic grid proximate the boundary.

19. The apparatus according to claim 3, wherein the container extends along an axis from a lower region to an upper region, wherein the upper region is located proximate the overflow outlet, and further wherein the magnetic grid is positioned orthogonal to the axis.

20. The method according to claim 3, wherein the magnetic grid generates a magnetic field within each opening of the plurality of openings, and further wherein the magnetic field within each opening of the plurality of openings is of a strength to prevent at least a portion of the transported magnetic material from entering the overflow outlet.

21. The method according to claim 3, wherein the magnetic grid comprises one or more layers of magnetic sheet strips defining the plurality of openings.

22. The method according to claim 3, wherein each opening of the plurality of openings in the magnetic grid comprises a rectangular shape.

23. The method according to claim 3, wherein the method further comprises coating at least a portion of the magnetic grid with a portion of the transported magnetic material.

24. The method according to claim 3, wherein the magnetic material comprises a plurality of magnetite particles, wherein the magnetic grid prevents at least a portion of the magnetite particles from entering the overflow outlet, and further wherein at least a portion of the plurality of magnetite particles prevented from entering the overflow outlet comprises a particle diameter that is less than or equal to 25 $\mu$m.

25. The method according to claim 3, wherein the medium comprises at least one of a gas or a liquid.

26. The method according to claim 3, wherein the method further comprises mixing the slurry with the medium before the slurry is directed into the container.

27. The method according to claim 11, wherein the magnetic grid is positioned orthogonal to the axis.

28. The method according to claim 11, wherein the magnetic grid comprises a permanently magnetized grid.

29. The method according to claim 11, wherein the magnetic grid generates a magnetic field within each opening of the plurality of openings, and further wherein the magnetic field within each opening of the plurality of openings is of a strength to prevent at least a portion of the transported magnetic material from entering the overflow outlet.

30. The method according to claim 11, wherein the magnetic grid comprises one or more layers of magnetic sheet strips defining the plurality of openings.

31. The method according to claim 11, wherein each opening of the plurality of openings in the magnetic grid comprises a rectangular shape.

32. The method according to claim 11, wherein the method further comprises coating at least a portion of the magnetic grid with a portion of the transported magnetic material.

33. The method according to claim 11, wherein the magnetic material comprises a plurality of magnetite particles, wherein the magnetic grid prevents at least a portion of the magnetite particles from entering the overflow outlet, and further wherein at least a portion of the plurality of magnetite particles prevented from entering the overflow outlet comprises a particle diameter that is less than or equal to 25 $\mu$m.

34. The method according to claim 11, wherein the medium comprises at least one of a gas or a liquid.

35. The method according to claim 11, wherein the method further comprises mixing the slurry with the medium before the slurry is directed into the container.

36. The method according to claim 16, wherein the magnetic grid is positioned orthogonal to the axis.

37. The method according to claim 16, wherein the magnetic grid comprises a permanently magnetized grid.

38. The method according to claim 16, wherein the magnetic grid generates a magnetic field within each opening of the plurality of openings, and further wherein the magnetic field within each opening of the plurality of openings is of a strength to prevent at least a portion of the transported magnetic material from entering the overflow outlet.

39. The method according to claim 16, wherein the magnetic grid comprises one or more layers of magnetic sheet strips defining the plurality of openings.

40. The method according to claim 16, wherein each opening of the plurality of openings in the magnetic grid comprises a rectangular shape.

41. The method according to claim 16, wherein the method further comprises coating at least a portion of the magnetic grid with a portion of the transported magnetic material.

42. The method according to claim 16, wherein the magnetic material comprises a plurality of magnetite particles, wherein the magnetic grid prevents at least a portion of the magnetite particles from entering the overflow outlet, and further wherein at least a portion of the plurality of magnetite particles prevented from entering the overflow outlet comprises a particle diameter that is less than or equal to 25 $\mu$m.

* * * * *